United States Patent [19]

Fergni et al.

[11] Patent Number: 5,018,225

[45] Date of Patent: May 28, 1991

[54] APPPARATUS FOR PREVENTING AND HEALING BEDSORES IN LONG-TERM INPATIENTS

[75] Inventors: Bruno Fergni, Pianoro; Giancarlo Venturi, Monzuno; Carlo Bedogni, Rimini, all of Italy

[73] Assignee: Italpres S.n.c. di Frengni Bruno & C., Pianoro, Italy

[21] Appl. No.: 452,550

[22] Filed: Dec. 18, 1989

[30] Foreign Application Priority Data

Dec. 23, 1988 [IT] Italy ..... 3711 A/88

[51] Int. Cl.[5] ..... B61G 7/00; B61G 7/012

[52] U.S. Cl. ..... 5/61; 5/63; 74/665 N

[58] Field of Search ..... 5/61, 63, 64, 65; 74/665 N

[56] References Cited

U.S. PATENT DOCUMENTS 3,302,219 2/1967 Harris ..... 5/61
3,643,604 2/1972 Jones et al. ..... 5/63
4,502,169 3/1985 Persson ..... 5/61
4,843,665 7/1989 Cockel et al. ..... 5/65

*Primary Examiner*—Alexander Grosz
*Attorney, Agent, or Firm*—Guido Modiano; Albert Josif

[57] ABSTRACT

The apparatus for preventing and healing bedsores in long-term inpatients comprises a bed which is supported by four elements arranged in pairs at the longitudinal sides of the bed. Each element is constituted by a tubular upright fixed to the bed frame, inside which a column is telescopingly accommodated. A roller is rotatably supported at the top of both columns arranged on each longitudinal side of the bed. A piece of fabric closed in a loop is wound around the two rollers. The fabric is moved with respect to the bed by lifting and lowering the columns, whereas the fabric can be caused to slide transversely with respect to the bed by actuating the rollers. Therefore, the patient is first lifted off the bed on which he is laying and is then turned in the required position by virtue of the lifting and sliding motion of the fabric.

1 Claim, 2 Drawing Sheets

APPPARATUS FOR PREVENTING AND HEALING BEDSORES IN LONG-TERM INPATIENTS

BACKGROUND OF THE INVENTION

The present invention relates to an apparatus for preventing and healing bedsores in long-term inpatients.

As is known, bedsores can form in the regions of the skin which remain compressed during long confinements in bed. In order to avoid forming of and to cure such bedsores it is therefore necessary to periodically change posture, and this requires the frequent assistance of specifically assigned personnel in the case of aged or immobilized patients.

Devices for varying the posture of a patient are known from German patent 742906 and from German patent applications 3126927 and 3438956. The known devices comprise a piece of fabric closed in the shape of a tube on a pair of longitudinal rollers which can be actuated by means of a crank. The fabric forms a sack in which the patient lays and is turned when the cloth is caused to slide laterally.

U.S. Pat. No. 3,302,219 provides the possibility of raising and lowering the patient containment sack by means of a motor unit composed of threaded columns actuated, by means of pinions and of a chain, by an electric motor. However, in this U.S. Pat. the structure for supporting and lifting the constitutes an obstacle when it is necessary to attend to the patient.

SUMMARY OF THE INVENTION

The technical aim of the present invention is therefore to solve the described problem by providing an apparatus which allows to easily and rapidly change the bed-laying posture of patients so as to prevent forming of and cure bedsores without creating obstacles which prevent a lateral approach to the patient.

Within the scope of this aim, an object of the present invention is to provide an apparatus which is simple in concept and is safe and reliable in operation.

This aim and this object are both achieved by an apparatus as defined in appended claim 1.

BRIEF DESCRIPTION OF THE DRAWINGS

The characteristics of the present invention will become apparent from the following description of an embodiment thereof, illustrated only by way of non-limitative example in the accompanying drawings, wherein.

DESCRIPTION OF THE PREFERRED EMBODIMENTS

Figure 1:
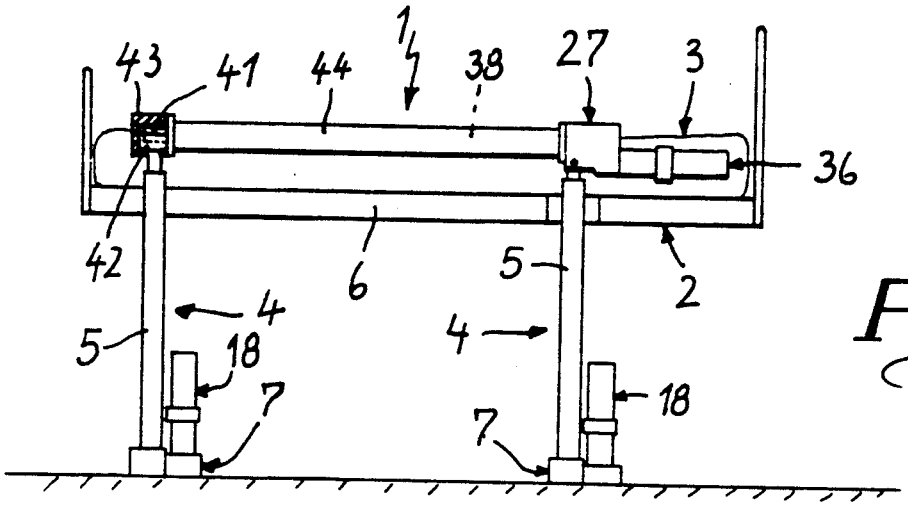
FIG. 1 is a lateral elevation view of the apparatus.

With reference to the above figures, the apparatus according to the invention is generally indicated by the reference numeral 1 and comprises a bed composed of a rectangular frame 2 on which a mattress 3 is arranged.

The bed is supported by four supporting elements 4 arranged in pairs at the sides of the bed.

Figure 2:
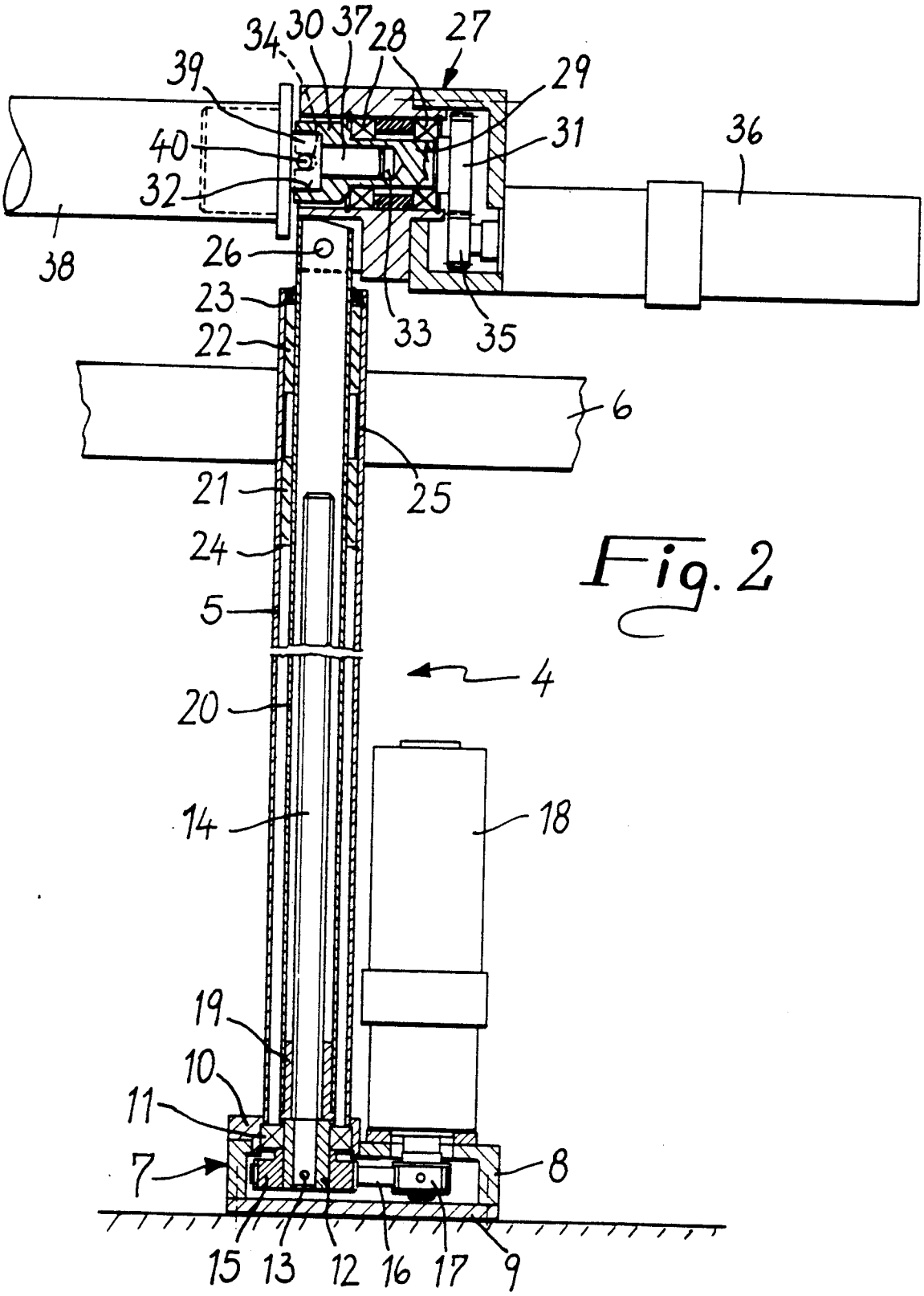
FIG. 2 is a section of a supporting element.

As is more clearly visible in FIG. 2, each supporting element comprises a tubular upright 5 which is vertically fixed to the longitudinal members 6 of the frame.

The upright 5, which has a circular cross section, rises from a shoe or resting base 7 which is essentially composed of a box 8 which is downwardly closed by a lid 9.

The upright 5 is inserted and fixed in a small plate 10 which is centered in a corresponding opening of the upper face of the box 8 and is fixed by means of screws.

A bush 12 is rotatably supported in the small plate 10 with the interposition of a bearing 11, and a threaded rod 14 is rigidly associated and rotatable with said bush by means of a dowel 13.

A toothed pulley 15 is also rigidly associated and rotatable with the bush 12 by means of said dowel 13, and a toothed belt 16 is engaged around said pulley.

The toothed belt 16 is closed in a loop on a toothed pinion 17 which is keyed on the output shaft of an electric motor 18 which is protrudingly flanged on the box 8 and extends upward parallel to the upright 5.

The threaded rod 14 extends coaxially inside the upright 5 and has a screw engagement with a female thread 19 which is internally fixed to the lower end of a tubular column or sleeve 20 interposed between the rod 14 and the upright 5.

The sleeve 20 is kept coaxially centered in the upright 5 by a pair of bushes 21, 22 retained between an upper ring 23 and a lower ring 24 which are accommodated in annular seats provided in the inner surface of the upright 5. The bushes 21, 22 are kept adjacent to the respective rings by an intermediate tubular spacer 25.

The sleeve 20 can be telescopingly extracted from the upright 5 and articulately supports, by means of a pivot 26 which is perpendicular to its axis, a box-like body 27 inside which a tang 29 is rotatably supported by means of two bearings 28.

The tang 29 defines a sort of cup 30 on one end and is provided with a coaxial toothed wheel 31 on the other end.

Said cup 30 defines a recess 32 from which a dead hole 33 extends along the axis of the tang 29. The cup 30 is furthermore provided, at its edge, with two slots 34 which are open in the opposite direction with respect to the toothed wheel 31 and are diametrical with respect to the axis of the tang 29.

A pinion 35 meshes with the toothed wheel 31 and is keyed on the output shaft of an electric motor 36 which is protrudingly flanged to the box-like body 27 parallel to the tang 29.

A pivot 37 is adapted to engage the hole 33 and extends axially from a roller 38. The pivot 37 has a cylindrical expansion 39 which is diametrically traversed by a dowel 40 the opposite ends whereof protrude from the periphery of said expansion 39.

When the pivot 37 is inserted in the dead hole 33, the expansion 39 engages the seat 32, whereas by appropriately orientating the roller 38 with respect to the tang 29 it is possible to cause the insertion of the dowel 40 in the slots 34 and therefore allow the traction of the roller 38 by the electric motor 36.

The roller 38 extends parallel to the longitudinal sides of the bed, and the end thereof which is opposite to the one supported in the box-like body 27 has a pivot 41 adapted to rest on a sort of saddle 42 which is rigidly mounted at the top of the sleeve 20 of an adjacent supporting element 4. A safety sleeve 43, which is axially applicable on the pivot 41, prevents the latter from accidentally disengaging from the saddle 42.

Thus from the above it is evident that the apparatus has two rollers 38 which are parallel and vertically movable along lateral planes of the bed. In lowered position, the rollers are substantially at the level of the mattress 3, so as to allow the patient to gain access to the bed.

A piece of fabric 44, closed in a loop and having a width equal to the length of said rollers, is wound around these same rollers. Said fabric can be applied or removed by extracting the safety sleeve 43 and by lifting the rollers 38 so as to cause their ends connected to the box-like body 27 to rotate about the pivots 26. The length of the fabric is appropriately defined so that said fabric is loose on the rollers so as to facilitate the laying of the patient and the operations for the periodic change of the laying posture.

The operation of the described apparatus is as follows.

Figure 3:
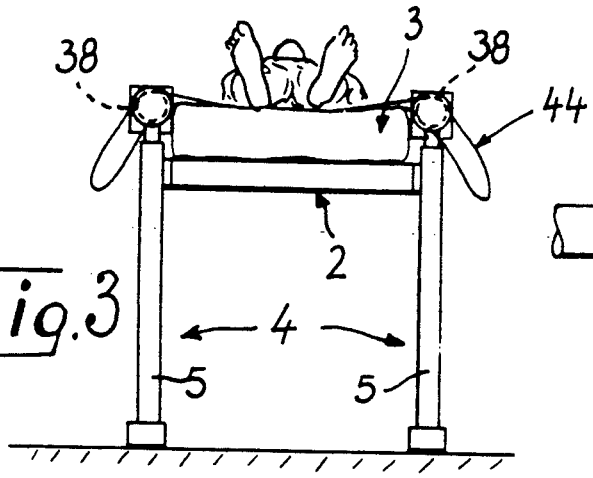
FIGS. 3 and 4 are front views of the apparatus, showing two operating conditions thereof.

In inoperative condition, the rollers 38 are lowered at the sides of the bed, as illustrated in FIG. 3, and the patient rests on the mattress with the fabric 44 acting as sheet.

When the patient is to be turned over, the motors 18 are activated, so that the threaded rods 14 cause, by rotating, the lifting of the sleeves 20 and of the rollers 38.

It should be noted that the rollers 38, by mutually connecting two sleeves 20 on each side of the bed, prevent said sleeves from being rotated by the threaded rods 14, so that said rods can screw in the female threads 19 and push them upward.

By lifting the rollers 38, the fabric 44 assumes the configuration of a sack (FIG. 4) the bottom whereof supports the patient which is lifted off the mattress.

At this point, by actuating the motor 36 in one direction or the other, it is possible to slide the fabric 44 and rotate the patient in the required direction. The rollers 38 are then lowered and the patient is placed on the bed in the new position thus assumed.

Figure 5:
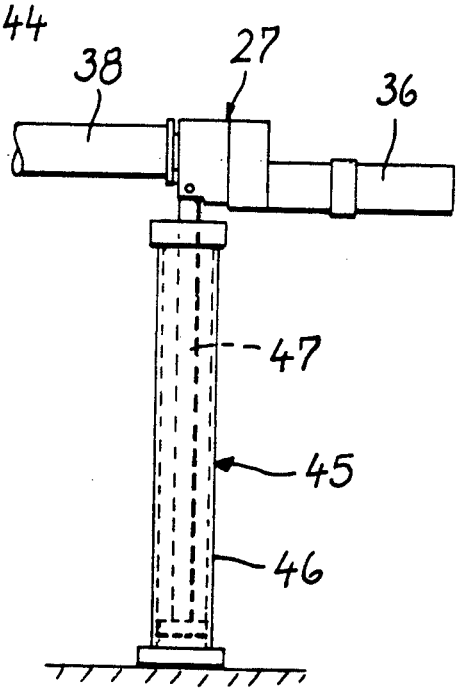
FIG. 5 is a schematic side view of a variated embodiment of the supporting elements.

The described invention is susceptible to numerous modifications and variations. In particular, lifting and lowering of the rollers 38, instead of by means of the mechanical system illustrated in FIGS. 1–4, can also be achieved by providing supporting elements 4 constituted by fluidodynamic jacks 45 (see FIG. 5) in which the cylinders 46 form the uprights to be fixed to the bed frame, whereas the stems 47 are the elements equivalent to the supporting sleeves 20 of the rollers.

The method of use of the described apparatus can be adapted to the specific requirements. For example, it is possible to lift a single roller 38 to cause a lateral movement of the patient onto a stretcher arranged to the side of the bed.

Figure 4:
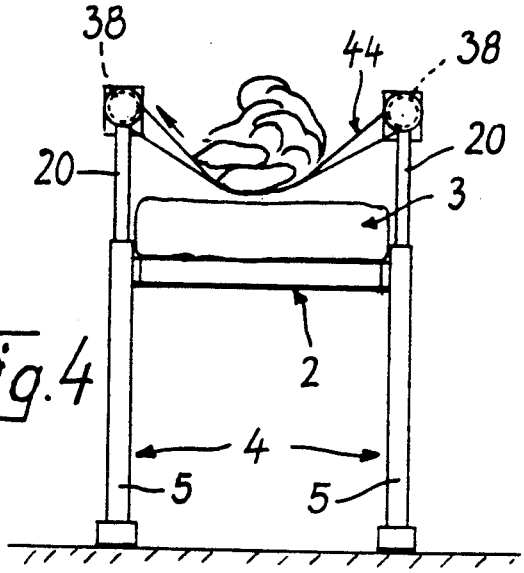

A particular advantage is to be found in the possibility, offered by the apparatus, of replacing the mattress when the patient is in raised position as in FIG. 4. By making of the bedheads detachable it is possible to extract the used mattress and insert a new one.

A further advantage is given by the possibility of changing the used fabric 44 with a new one without having to remove the patient from the bed.

For this purpose, the patient is first raised to the position of FIG. 4. The new fabric is then inserted below the patient, who is placed on the bed again. At this point the rollers 38 are removed from the used fabric and inserted in the new one. By again lifting the patient and actuating the rollers 38, the used fabric is extracted laterally and the patient is placed on a new fabric.

We claim:

1. An apparatus for preventing and curing bedsores, comprising a bed including a bed frame and two pairs of supporting elements, each pair being disposed at a respective side of said frame, and each supporting element comprising a vertical tubular upright fixed to said frame and having a box-like base, a tubular column telescopingly guided inside said tubular upright and provided with an internal female thread, a pair of parallel fabric traction rollers, each roller having coaxial opposite pivots supported for rotation on the top portion of the columns of a respective pair of supporting elements, a piece of fabric closed in a loop around said pair of rollers, means for axially actuating said column and thereby lifting or lowering said pair of rollers with respect to the bed frame, and means for rotating said pair of rollers and moving said piece of fabric wound thereon, said roller lifting and lowering means comprising for each column a threaded rod coaxially extending inside each columns engaging said female thread and rotatably supported in said base, a toothed pulley keyed onto said rod inside said base, an electric motor flanged on said base and having a toothed pinion inside said base, and a toothed belt wound in a loop about said toothed pulley and pinion, and said means for rotating each roller comprising a box-like body articulated to the top portion of a column of each pair, a tang rotatably supported inside said box-like body and coaxially to said roller and an electric motor flanged onto said box-like body and driving said tang, said tang comprising a cup-like portion having a recess for prismatic engagement with a pivot of said roller, said prismatic engagement being defined by a dowel extending transversely through said pivot and engaging slots formed in the edge of said cup-portion.

* * * * *

UNITED STATES PATENT OFFICE

CERTIFICATE OF CORRECTION

Patent No. 5,018,225 Dated May 28, 1991

Inventor(s) Bruno FREGNI; Giancarlo VENTURI; Carlo BEDOGNI

It is certified that error appears in the above-identified patent and that said Letters Patent is hereby corrected as shown below:

On the title page:

n item (75) and item (19), first line, change "Fergni" to --Fregni--.

In item (73), first line, please change "Frengni" into --Fregni--.

Signed and Sealed this

Twelfth Day of January, 1993

*Attest:*

*Attesting Officer*

DOUGLAS B. COMER

*Acting Commissioner of Patents and Trademarks*